US006693376B1

(12) United States Patent
Ito et al.

(10) Patent No.: US 6,693,376 B1
(45) Date of Patent: Feb. 17, 2004

(54) ELECTRON BEAM EMITTING APPARATUS WITH POTENTIAL DEFINING REGION AND IMAGE-FORMING APPARATUS HAVING THE SAME

(75) Inventors: Nobuhiro Ito, Kanagawa (JP); Hideaki Mitsutake, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 09/699,394

(22) Filed: Oct. 31, 2000

Related U.S. Application Data

(63) Continuation of application No. PCT/JP00/01193, filed on Mar. 1, 2000.

(30) Foreign Application Priority Data

Mar. 2, 1999 (JP) ..... 11-053793

(51) Int. Cl.[7] ..... H01J 1/62; H01J 63/04

(52) U.S. Cl. ..... 313/495; 313/496; 313/310; 315/169.1; 315/169.3

(58) Field of Search ..... 313/495, 496, 313/309, 310, 336, 351; 315/169.1, 169.3, 169.4

(56) References Cited

U.S. PATENT DOCUMENTS

| | | | | |
|---|---|---|---|---|
| 4,956,578 A | * | 9/1990 | Shimizu et al. | 315/3 |
| 5,659,329 A | * | 8/1997 | Yamanobe et al. | 313/309 |
| 5,936,343 A | * | 8/1999 | Fushimi et al. | 313/253 |
| 6,005,540 A | * | 12/1999 | Shinjo et al. | 313/309 |
| 6,124,671 A | * | 9/2000 | Fushimi et al. | 313/250 |
| 6,288,494 B1 | * | 9/2001 | Tsukamoto et al. | 313/306 |
| 6,380,665 B1 | * | 4/2002 | Motoi et al. | 313/310 |

FOREIGN PATENT DOCUMENTS

| | | |
|---|---|---|
| EP | 0 865069 A2 | 3/1998 |
| JP | 9-27264 | 1/1997 |
| JP | 9-27285 | 1/1997 |
| JP | 10-255692 | 9/1998 |
| JP | 10-321167 | 12/1998 |
| JP | 11-317181 | 11/1999 |

OTHER PUBLICATIONS

W.P. Dyke et al., "Field Admission", Advances in Electronics and Electron Physics, vol. 8 (Academic Press, 1956) pp. 89–185.

C.A. Spindt et al., "Physical Properties of Thin–Film Field Emission Cathodes with Molybdenum Cones", Journal of Applied Physics, vol. 47, No. 12, Dec. 1976, pp. 5248–5263.

M.I. Elinson et al., "The Emission of Hot Electrons and the Field Emission of Electrons from Tin Oxide", Radio Engineering and Electronic Physics, Jul. 1965, pp. 1290–1296.

(List continued on next page.)

*Primary Examiner*—Vip Patel
*Assistant Examiner*—Kevin Quarterman
(74) *Attorney, Agent, or Firm*—Fitzpatrick, Cella, Harper & Scinto

(57) ABSTRACT

An electron beam emitting apparatus has a first plate with an electron-emitting device 15, and an electrode 8 opposed to the first plate, and the electrode 8 is applied a potential to accelerate electrons emitted from the electron-emitting device 15. In the electron beam emitting apparatus, a potential defining region 9 is provided a surface of the first plate on the electrode 8 side and a first potential defining region forming the potential defining region 9 is provided in a projective area of the electrode 8 onto the potential defining region 9; and, where d represents a distance between the electrode 8 and the potential defining region 9, an additional potential defining region is defined in the range of 0.83d in all directions parallel to the first plate from the edge of the projective area of the electrode 8 onto the potential defining region 9. This stabilizes trajectories of electrons and permits an excellent image to be formed without deviation of light emission positions.

6 Claims, 15 Drawing Sheets

OTHER PUBLICATIONS

C.A. Mead, "Operation of Tunnel–Emission Devices", Journal of Applied Physics, vol. 32, No. 4, Apr. 1961, pp. 646,652.

H. Araki, "Electroforming and Electron Emission of Carbon Thin Films", Journal of the Vacuum, Society of Japan, 1983, pp. 22–29 (with English Abstract on p. 22).

G. Dittmer, "Electrical Conduction and Electron Emission of Discontinuous Thin Films", Thin Solid Films, 9, 1972, pp. 317–328.

M. Hartwell, Strong Electron Emission from Pattered Tin–Indium Oxide Thin Films, IDEM, 1975, pp. 519–521.

* cited by examiner

ELECTRON BEAM EMITTING APPARATUS WITH POTENTIAL DEFINING REGION AND IMAGE-FORMING APPARATUS HAVING THE SAME

This application is a continuation of International Application No. PCT/JP00/01193, filed Mar. 1, 2000, which claims the benefit of Japanese Patent Application No. 11-053793, filed Mar. 2, 1999.

TECHNICAL FIELD

The invention disclosed in the present application relates to electron beam emitting apparatus and image-forming apparatus. More particularly, the invention concerns the electron beam emitting apparatus and image-forming apparatus provided with a lot of electron-emitting devices.

BACKGROUND ART

There are two types of electron-emitting devices known heretofore, thermionic emission sources and cold-cathode emission sources, and there are also the known image-forming apparatus making use of these electron sources.

The image-forming apparatus illustrated in FIG. 11 is known as a plane type image-forming apparatus using the thermionic emission source. FIG. 11 is a schematic structural diagram of the image-forming apparatus using the conventional thermionic emission source.

This image-forming apparatus has a plurality of anodes 1502, which are arranged in parallel on an insulating substrate 1501 and the surface of which is coated with a material that emits fluorescence upon collision of an electron beam therewith (phosphor), a plurality of filaments 1503, which are arranged in parallel and opposite to the anodes 1502, and a plurality of grid electrodes 1504, which are arranged perpendicular to the anodes 1502 and filaments 1503 between the anodes 1502 and the filaments 1503, and these anodes 1502, filaments 1503, and grid electrodes 1504 are held in a transparent vessel 1505. The vessel 1505 is hermetically bonded (hereinafter referred to as "sealed") to the insulating substrate 1501 so as to be able to keep the inside in vacuum, and the inside of the envelope constructed of the vessel 1505 and the insulating substrate 1501 is kept in the vacuum of about $1.3\times10^{-4}$ Pa.

The filaments 1503 emit electrons when heated in vacuum and, with application of respectively appropriate voltages to the grid electrodes 1504 and to the anodes 1502, the electrons emitted from the filaments 1503 collide with the anodes 1502, whereupon the phosphor on the anodes 1502 emits fluorescence. Light-emitting positions can be controlled by matrix addressing of the lines of anodes 1502 (in the X-direction) and the lines of grid electrodes 1504 (in the Y-direction), whereby an image can be displayed through the vessel 1505.

The image-forming apparatus using the thermionic emission source, however, has the following problems: (1) power consumption is large, (2) it is difficult to implement large-capacity display because of slow modulation speed, and (3) variation occurs readily among the devices, and it is not easy to realize a large screen, because the structure becomes complex. Thus there are also the image-forming apparatus using the cold-cathode emission source instead of the thermionic emission source.

The cold-cathode emission sources include field emission type (hereinafter referred to as "FE type"), metal/insulator/metal type (hereinafter referred to as "MIM type"), surface conduction electron-emitting devices, and so on.

Examples of the known FE type devices are those described in W. P. Dyke & W. W. Dolan, "Field emission", Advance in Electron Physics, 8, 89 (1956), or in C. A. Spindt, "Physical Properties of thin-film field emission cathodes with molybdenum cones", J. Appl. Phys., 47, 5248, (1976), and so on.

An example of the image-forming apparatus using this FE type electron source will be described referring to FIG. 12. FIG. 12 is a schematic, structural diagram to show the conventional image-forming apparatus with the FE type electron source, partly enlarged.

As illustrated in FIG. 12, this image-forming apparatus has an electron source 2001, in which many electron-emitting devices are formed, and a face plate 2003 opposed to the electron source 2001. The electron source 2001 is comprised of a lot of micropoints 2013, which are formed in an electrically connected state through electric conductors 2012 on an insulating substrate 2011, and a grid 2015, which has apertures corresponding to the micropoints 2013 and which is supported on the insulating substrate 2011 while being electrically insulated from the micropoints 2013 by insulating layer 2014. The bottoms of the micropoints 2013 have the diameter and height of about 2 $\mu$m and the diameter of the apertures in the grid 2015 is also about 2 $\mu$m.

The face plate 2003 is comprised of the phosphor 2032, which is laid on the inner surface of glass sheet 2031, and an electroconductive film 2033, which covers the phosphor 2032 and which acts as an acceleration electrode to which a voltage for accelerating electrons emitted from the micropoints 2013 is applied.

In the above structure, the distance is very small between the tips of the micropoints 2013 and the grid 2015 (not more than 1 $\mu$m), and the tips of the micropoints 2013 are of a pointed shape. Therefore, a strong electric field (not less than $10^7$ V/cm) capable of field electron emission can be created between the micropoints 2013 and the grid 2015 even by the potential difference of not more than 100 V. The amount of electron emission from one micropoint 2013 is approximately several $\mu$A. Since it is possible to form approximately several ten thousand micropoints 2013 per mm$^2$, an electron-emitting device corresponding to one pixel is normally composed of a set of about several thousand to several ten thousand micropoints 2013 in the image-forming apparatus. Therefore, the electron emission amount can be over several mA per electron-emitting device corresponding to one pixel.

The potentials at the grid 2015 and at the micropoints 2013 are set, for example, as follows: the earth potential (0 V) is applied to the grid 2015 and a negative potential (about −100 V) is applied through the conductor 2012 to the micropoints 2013, which implements electron emission. Further, a potential equal to or greater than that at the grid 2015 is applied through the conductive film 2033 to the face plate 2003, whereby the electrons emitted from the electron source 2001 come to collide with the phosphor 2032 to excite the phosphor and effect light emission thereof.

For controlling luminous points of this emission, there are provided a plurality of row wires 2041 formed of an array of X-directional beltlike conductors 2012, each being electrically connected to a plurality of micropoints 2013, and column wires 2042 of the grid 2015 electrically connected in the Y-direction, and an image can be displayed in such a manner that matrix addressing is implemented so as to apply a voltage over a desired electron emission start voltage to desired areas out of a plurality of electron-emitting device areas 2010 formed at intersections of this matrix wire pattern from external power supplies 2043, 2044, thereby selecting positions where the electrons impinge upon the phosphor 2032 to which the voltage is applied through the conductive film 2033 from an acceleration voltage supply 2045.

On the other hand, examples of the known MIM devices are those described in C. A. Mead, "Operation of Tunnel-emission Devices", J. Appl. Phys., 32,646 (1961) and so on.

Examples of the surface conduction electron-emitting devices are those described in M. I. Elinson, Radio Eng. Electron Phys., 10, (1965) and so on.

The surface conduction electron-emitting devices are the electron-emitting devices making use of the phenomenon that electron emission occurs when electric current flows in parallel to the surface in small-area thin film formed on a substrate. The surface conduction electron-emitting devices reported heretofore include those using thin films of $SnO_2$ reported by aforementioned Elinson et al., those using thin films of Au [G. Dittmer: "Thin Solid Films," 9,317 (1972)], those using thin films of $In_2O_3/SnO_2$ [M. Hartwell and C. G. Fonstad: "IEEE Trans. ED Conf.", 519 (1975)], those using thin films of carbon [Hisashi Araki et al.: Vacuum, vol 26, No. 1, p22 (1983)], and so on.

FIG. 13 is a plan view of the device reported by aforementioned M. Hartwell et al., which is a typical example of the device configuration of these surface conduction electron-emitting devices. In the same figure numeral 3001 designates a substrate and 3004 an electroconductive thin film made of a metallic oxide by sputtering. The conductive thin film 3004 is formed in a plane shape of H-pattern as illustrated. An electron-emitting region 3005 is made by an energization process called energization forming described hereinafter, in the conductive thin film 3004. In the figure the clearance L between the device electrodes is set to 0.5 to 1 mm and W to 0.1 mm. For convenience sake of illustration, the electron-emitting region 3005 is illustrated in the rectangular shape in the center of the conductive, thin film 3004, but this is just a schematic illustration, which does not always loyally represent the position and shape of the actual electron-emitting region.

In the above-stated surface conduction electron-emitting devices including the device by M. Hartwell et al., it was common practice to form the electron-emitting region 3005 by subjecting the conductive thin film 3004 to the energization process called energization forming before execution of electron emission. Namely, the energization forming is a process of placing a constant, direct current or a direct current with increasing voltage at a very slow rate, for example, of about 1 V/min between the both ends of the conductive thin film 3004 to energize it, so as to locally break or deform or modify the conductive thin film 3004, thereby forming the electron-emitting region 3005 in an electrically high resistance state.

A fissure is created in part of the locally broken or deformed or modified, conductive thin film 3004. When an appropriate voltage is applied to the conductive thin film 3004 after the energization forming, electron emission occurs near the fissure.

Since the cold-cathode emission sources described above can be made by the technology, for example, such as photolithography, etching, and the like, it is feasible to place many devices at small intervals. In addition, the cathodes and surroundings can be driven under relatively lower temperature conditions than in the case of the thermionic emission sources, and thus multiple electron beam emission sources can be readily realized at finer array pitch. Among these cold-cathode emission sources, the surface conduction electron-emitting devices are particularly suitable for the electron-emitting devices used in the large-screen image-forming apparatus desired recently, because they are advantageous in that the device structure is simple and easy to produce and in that it is easy to produce a large-area screen.

For example, a known image-forming apparatus using the electron-emitting devices of this type is constructed in such structure that an electron source with the electron-emitting devices formed therein is opposed through a support frame to an image-forming member equipped with the phosphor or the like emitting fluorescence upon collision of electrons therewith and that the inside of an envelope composed of these electron source, image-forming member, and support frame is kept in vacuum.

The image-forming member is provided with the acceleration electrode for accelerating the electrons emitted from the electron source toward the image-forming member, and the emitted electrons are accelerated toward the image-forming member with application of high voltage to the acceleration electrode, to collide with the image-forming member. Therefore, the support frame is made of an insulating material resistant to the high voltage.

DISCLOSURE OF THE INVENTION

An object of the invention in the present application is to realize suitable electron beam emitting apparatus.

One aspect of the invention of the electron beam emitting apparatus in the present application is configured as follows.

An electron beam emitting apparatus comprises a first plate in which an electron-emitting device is formed and an electrode opposed to the first plate, the electrode being applied a potential for accelerating electrons emitted from the electron-emitting device, the electron beam emitting apparatus being characterized in that a potential defining region is provided on a said-electrode-side surface of said first plate and a first potential defining region constituting said potential defining region is provided in a projective area of said electrode onto said potential defining region and in that, where d represents a distance between said electrode and said potential defining region, a marginal area to be potential-defined is defined in a range of 0.83d in all directions parallel to said first plate from the edge of the projective area of said electrode onto said potential defining region and an additional potential defining region is provided in almost all the marginal area to be potential-defined.

The potential defining region can be either of various configurations and desirably one with some electric conductivity capable of defining the potential. Specifically, the potential defining region is desirably one having the surface resistance of not more than $1\times10^{12}$ Ω/□. It can also be contemplated that wiring having other function as well constitutes at least part of the potential defining region. For example, the wires connected to the electron-emitting device can also serve as the potential defining region. An electric conductor of film shape can also be provided as the potential defining region other than the wires. In this case there are various ways of defining the potential of the conductor of film shape, and a suitable configuration is such that the potential of the conductive film is defined by electrically connecting the conductive film to some wiring. The wiring can be the aforementioned wires connected to the electron-emitting device. When the conductive film forming the potential defining region is one with high resistance, it becomes feasible to provide the conductive film in contact with a plurality of wires connected to the electron-emitting device.

The first potential defining region and the additional potential defining region do not have to be separate members. Suitably applicable configurations include a configuration in which a certain member, e.g. a certain wire, serves as the first potential defining region in the first potential defining zone and as the additional potential defining region in the additional potential defining zone and a configuration in which a conductive film simultaneously formed in the first potential defining zone and in the additional potential defining zone serves as the first potential defining region in the first potential defining zone and as the additional potential defining region in the additional potential defining zone.

The potential defining region (the first potential defining region and the additional potential defining region) is exposed to an atmosphere (particularly, a reduced pressure or vacuum atmosphere) in the apparatus.

The phrase "the additional potential defining region is provided in almost all the marginal area to be potential-defined" stated herein means that the additional potential defining region is provided in not less than 80% of the marginal area to be potential-defined. Insulating areas not potential-defined may exist in part in the marginal area to be potential-defined, but the rate thereof needs to be not more than 20% of the marginal area to be potential-defined. Further, where the insulating areas exist in the marginal area to be potential-defined, it is particularly preferable that the size of each insulating area be not more than 0.5d×0.5d.

It is also desirable that the first potential defining region provided in the projective area of the electrode be provided in almost all the projective area. Specifically, the first potential defining region is preferably provided in the area not less than 80% in the projective area. Some areas can be insulating areas not potential-defined in the projective area, but the rate thereof needs to be not more than 20% of the projective area. Further, where the insulating areas exist in the projective area, it is particularly preferable that the size of each insulating area be not more than 0.5d×0.5d.

Further preferably, it is desirable that the additional potential defining region be one specified in such a way that the marginal area to be potential-defined is set in a range of d in all the directions parallel to the first plate from the edge of the projective area of the electrode onto the potential defining region (the so-set marginal area being referred to hereinafter as an expanded marginal area to be potential-defined) and that the additional potential defining region is provided in almost all the marginal area to be potential-defined. In this case, the phrase "the additional potential defining region is provided in almost all the expanded marginal area to be potential-defined also means that the additional potential defining region is provided in the area not less than 80% of the expanded marginal area to be potential-defined. In the expanded marginal area to be potential-defined, the suitably permissible condition for insulating areas is the same as described above.

It is preferable that areas with the surface resistance of not more than $1\times10^5$ Ω/□ exist 50% or more in the projective area and the marginal area to be potential-defined, or in the projective area and the expanded marginal area to be potential-defined. Particularly, it is preferable that areas with the surface resistance of not more than $1\times10^5$ Ω/□ exist 50% or more in the marginal area to be potential-defined or in the expanded marginal area to be potential-defined.

It is also preferable that the electrode be provided on a second plate opposed to the first plate and that the electrode be provided in a range extended by at least the distance 2αd (where α is a value not less than 0.6 and not more than 1) in all directions parallel to the second plate from the edge of an irradiated area which electrons emitted from the electron-emitting device irradiate.

At least part of the potential defining region may be comprised of an electroconductive plate placed between the first plate and the electrode.

The potential defining region may be provided in contact with the first plate or spaced away therefrom. When spaced away, it can be provided as an electroconductive plate. The potential defining region can be provided as an additional control electrode such as the grid electrode or the like, different from the electrode.

Each of the invention described above can be particularly suitably applicable to the structure with a plurality of above-stated electron-emitting devices. Particularly, the invention is suitable for the structure in which the plurality of electron-emitting devices are arranged in a matrix pattern. A suitably applicable configuration is such that a plurality of electron-emitting devices are arranged in a matrix pattern and the plurality of devices are wired in the matrix pattern with a plurality of row-directional wires and a plurality of column-directional wires provided approximately along a direction perpendicular to the row-directional wires.

The cold-cathode emission devices can suitably be adopted as the electron-emitting devices. Particularly, the field emission type and surface conduction electron-emitting devices can be suitably used.

The present application also includes the invention of the image-forming apparatus comprising the above-stated electron beam emitting apparatus and the phosphor emitting light under irradiation of electrons emitted from the electron-emitting device of the electron beam emitting apparatus, as the invention of the image-forming apparatus.

MODE FOR CARRYING OUT THE INVENTION

Figure 1:
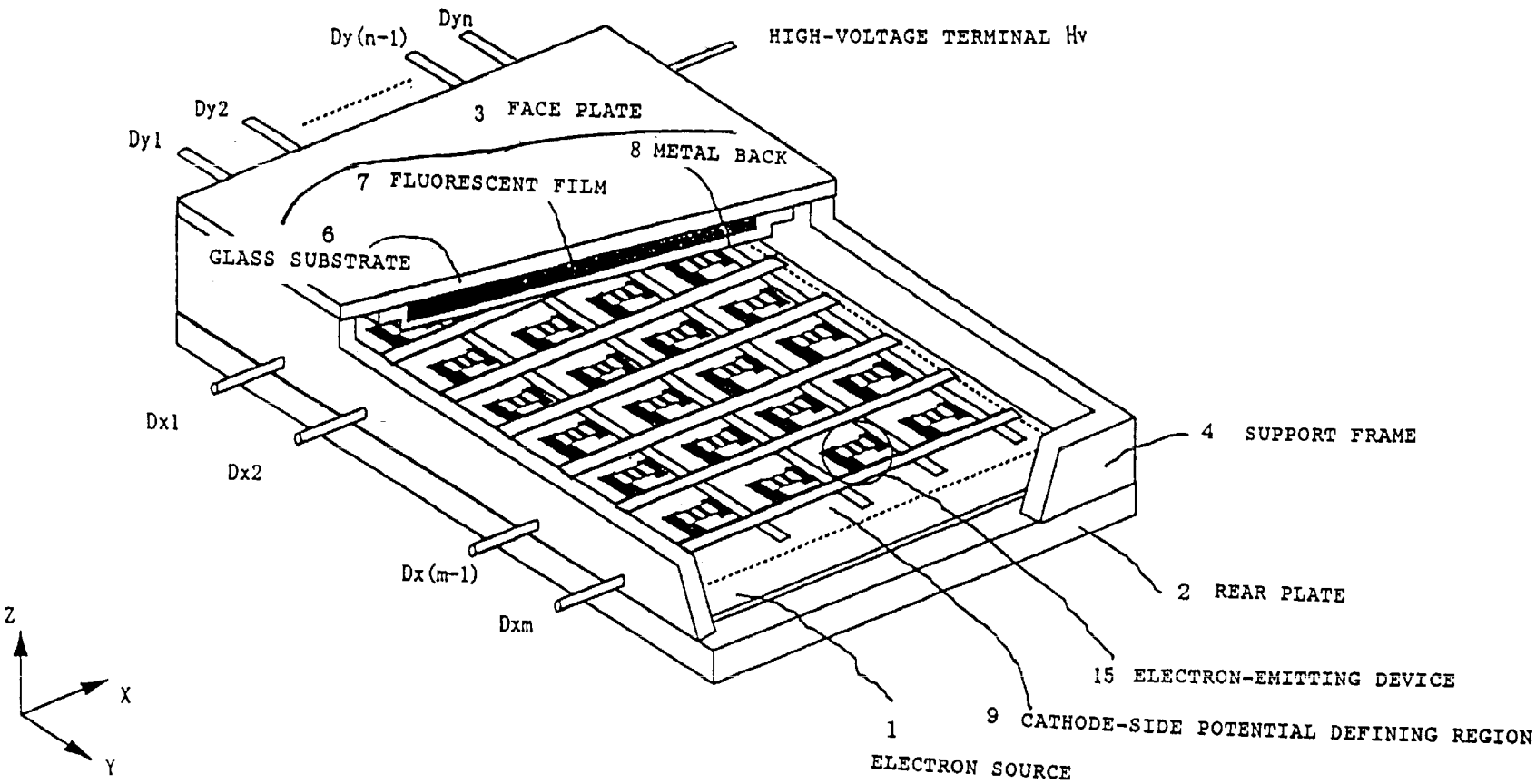
FIG. 1 is a perspective view of the first embodiment of the image-forming apparatus of the present invention, partly broken.

The image-forming apparatus makes use of the phenomenon that the phosphor emits light when electrons emitted from the electron source collide with the phosphor of the image-forming member, and the following problems can arise therewith.

They are (1) the problem of field concentration due to the electrode layout in the peripheral area of the cathode, (2) the problem of charging of insulating members in the peripheral area of the anode (charging due to reflected electrons), and (3) the problem of charging of insulating members in the peripheral area of the cathode (charging due to positively charged particles).

The above disturbance can lead to such situations that local charging occurs in the peripheral area, beam trajectories are distorted, and discharge is induced, so as to lower the dielectric breakdown voltage of the electron beam emitting device. Each of the problems will be described below in detail.

First described is (1) the above problem of field concentration due to the electrode layout in the peripheral area of the cathode.

From the macroscopic view, the electron beam emitting apparatus of the present invention can be regarded as a parallel-plate capacitor consisting of a set of cathode and anode. A parallel electric field is established in the most area except for the peripheral region of the gap between the cathode and anode and the field distribution is basically uniform. However, the parallel field is disturbed in the peripheral areas of the cathode and anode and field-concentrated points appear at the border between metal and insulator, i.e., at the border between the potential defining region and the substrate.

According to the result of computation of electric field, in the case where the anode and cathode have the same area, the electric field at the border between the potential defining region and the substrate is about 1.3 times greater than that in the internal space of the gap between the anode and cathode. The field emission is normally not symmetric between at the cathode and at the anode and the electron emission is more likely to occur from the cathode side. For this reason, the field concentration due to the above geometric layout can be captured as field emission of electrons from the border between the cathode and the substrate. When the above field emission is induced, it can be one of causes to bring about the deviation of beam trajectory and local discharge because of charging of the substrate of the electron beam emitting apparatus. This field concentration in the border area occurs with application of the acceleration voltage to the anode, independent of emission and non-emission of the electron beam emitting device on the cathode. Therefore, it posed a problem that the field concentration was not able to be relaxed by non-select periods of the electron source.

Next, (2) the above problem of charging of the insulating members in the peripheral area of the anode (charging due to reflected electrons) will be described below referring to FIG. 14.

Figure 14:
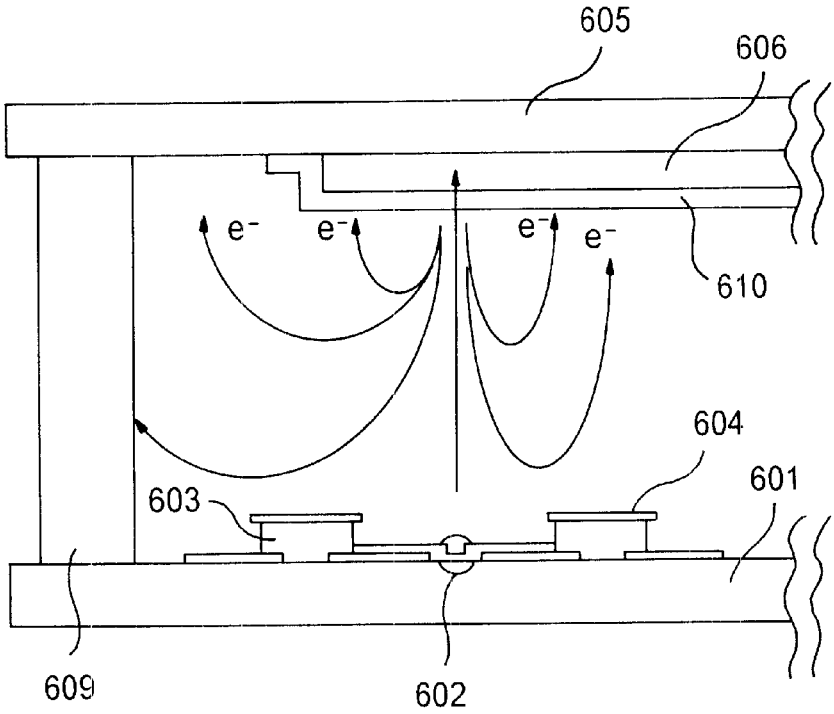
FIG. 14 is a schematic diagram to explain the charging process of the face plate by reflected electrons from the anode.

In FIG. 14, the image-forming apparatus is constructed in such structure that a metal back 610 is formed as an anode and that an image-forming member 606 consisting of phosphor and black stripes is formed in an image-forming area. In FIG. 14, 602 denotes an electron emitting area, 603 denotes an insulating layer, and 604 denotes a wiring. In the image display apparatus with the flat panel (type) electron beam emitting devices according to the present invention, approximately 5 to 20% electrons are scattered backwards out of those impinging upon the image-forming member 606 consisting of the phosphor, which emit visible light upon collision of electron beams, and the black stripes, and upon the aluminum metal back 610 of a light reflecting layer, as illustrated in FIG. 14, and the backwardly scattered electrons are again incident to the metal back 610, to which the high voltage is applied, because of the electric field.

Further, part of the backwardly scattered electron beams collide with the face plate 605 and side wall part 609 made of an insulating material of glass or the like to bring about emission of secondary electrons and emission of gas due to desorption of adsorbed gas. A positive charge equal to $(\delta-1)$ times current of incident electrons appears in the glass of insulating material according to secondary electron emission efficiency of the insulating material. The charge thus generated is accumulated because of low conductivity of the insulator, so as to cause the local charging of the face plate, which will disturb the electric field. This disturbance of the electric field will result in failing to achieve desired electron beam trajectories. There were cases where chromatic deviation or the like occurred. With desorption of adsorbed gas, discharge becomes easy to occur because of electron avalanche, and it sometimes damaged the electrodes and wires on the side of rear plate 601 and, in turn, the electron-emitting devices.

Next described below is (3) the above problem of charging of the insulating members in the peripheral area of the cathode (charging due to positively charged particles).

Positive ions are generated because of reaction upon collision of electrons against the image-forming member and ionization of ambient gas inside the apparatus. These positive ions are accelerated in the direction opposite to that of the electrons emitted from the electron source by the electric field established between the electron source and the image-forming member by the acceleration electrode, to reach the electron source. On the other hand, in the case where there exist many insulating portions in the electron source, when the positive ions reaching the electron source charge the insulating portions of the electron source, the electrons emitted from the electron-emitting devices are attracted toward the insulating portions thus charged, so as to cause the deviation of trajectories, which will pose a problem of deviation of light emitting positions or the like. The charge increases the probability of occurrence of discharge or the like, so as to degrade reliability and lifetime of the apparatus.

The disturbance of electric field and the discharge due to the above problems were significant issues relating to high definition/high color purity and further to the reliability of the flat panel type image-forming apparatus in the field of the flat panel type image-forming apparatus.

The applicant has elaborated a system wherein a simple matrix type electron source with an array of many surface conduction electron-emitting devices was formed in a matrix pattern by connecting pairs of opposed device electrodes of the surface conduction electron-emitting devices with a plurality of row-directional wires and a plurality of column-directional wires and wherein electron emission amounts could be controlled by selecting many surface conduction electron-emitting devices with application of appropriate driving signals to the rows and to the columns, as a method of realizing the image-forming apparatus with the surface conduction electron-emitting devices in a simple configuration.

In the case of such simple matrix type image-forming apparatus with the surface conduction electron-emitting devices, there also possibly occurs the charging in the surface of the insulating members and it can affect the electron trajectories similarly. The above-described problem of the deviation of electron trajectories also arises similarly in the electron beam emitting apparatus without use of the phosphor as the electron-irradiated member, as in the image-forming apparatus.

The inventor of the present application found out that the electric field became about 1.3 times at the edge of the potential defining region. In view of that point and further in view of easiness of occurrence of discharge on the cathode side, one aspect of the present invention is that the potential defining region on the cathode side is provided in the range of at least 0.83d (where d is the distance between the potential defining region on the cathode side and the electrode on the anode side) in the in-plane directions of the plate from the edge of the projective area of the anode-side electrode (acceleration electrode) whereby the distance between the edge of the potential defining region on the cathode side and the edge of the electrode (acceleration electrode) on the anode side becomes about 1.3 or more times the distance between the potential defining region on the cathode side and the electrode on the anode side.

The preferred embodiments of the present invention will be described hereinafter with reference to the accompanying drawings, but it should be noted that the present invention is by no means intended to be limited to these embodiments.

Figure 2:
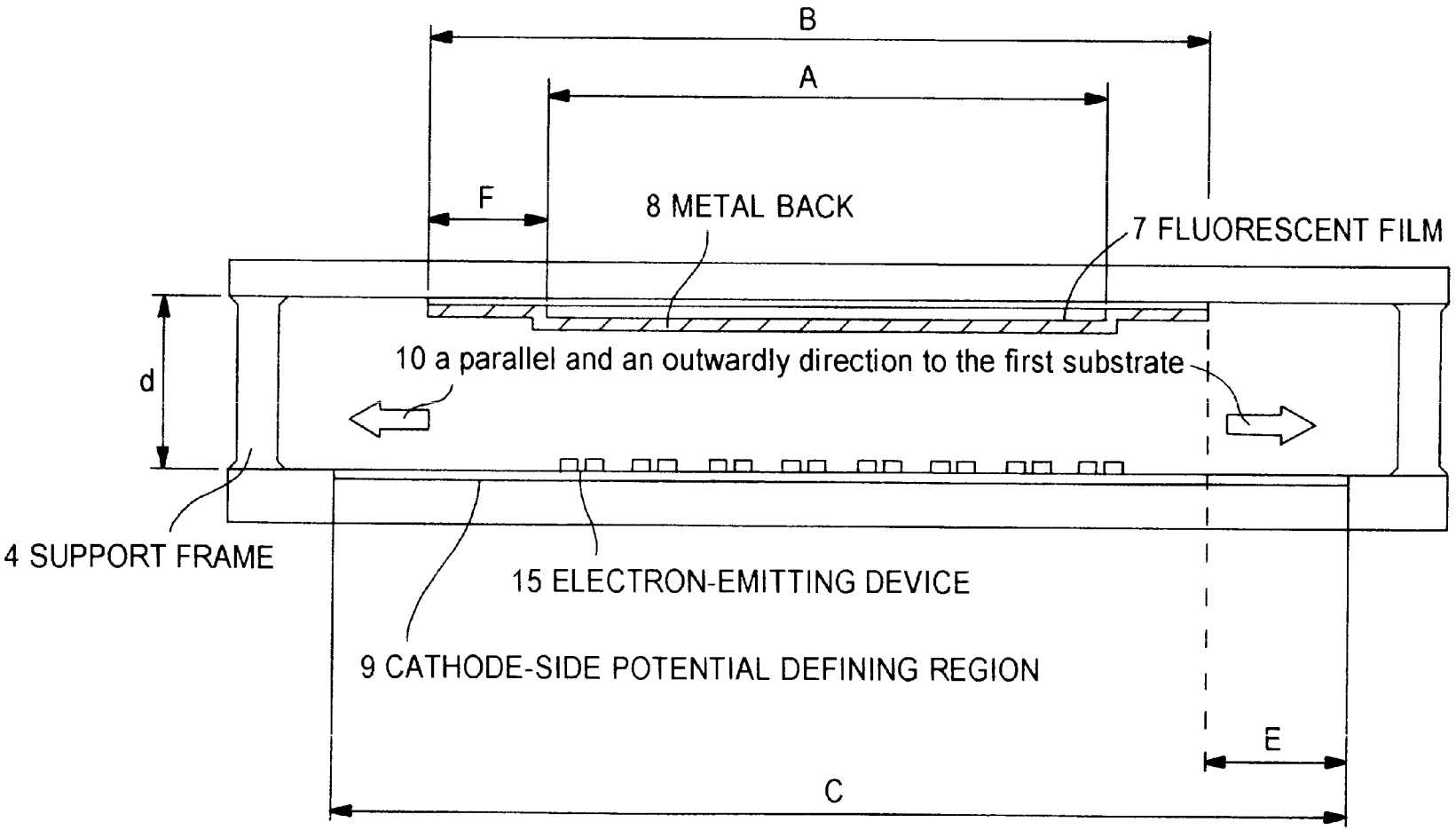
FIG. 2 is a diagram to schematically show a cross section of the image-forming apparatus illustrated in FIG. 1, as a view observed from the Y-direction.

FIG. 1 is a perspective view of the first embodiment of the image-forming apparatus, partly broken, which is an application of the electron beam emitting apparatus of the present invention, and FIG. 2 is a diagram to schematically show a cross section of the image-forming apparatus illustrated in FIG. 1, which is a view from the Y-direction.

In FIG. 1, the electron source 1 with an array of surface conduction electron-emitting devices 15 in the matrix pattern is fixed to the rear plate 2. The face plate 3 as an image-forming member, in which a fluorescent film 7 and the metal back 8 of the acceleration electrode are formed on the internal surface of glass substrate 6, is placed through a support frame 4 of an insulating material opposite to the electron source 1, and a high voltage is applied between the electron source 1 and the metal back 8 from an unrepresented power supply. These rear plate 2, support frame 4, and face plate 3 are sealed to each other with frit glass or the like, whereby the rear plate 2, support frame 4, and face plate 3 compose an envelope 10.

Figure 15:
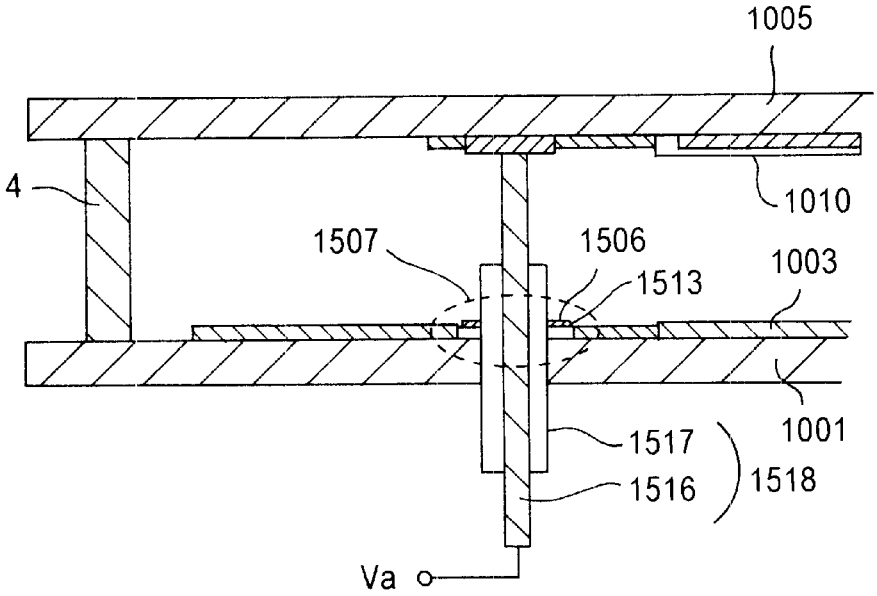
FIG. 15 is a diagram to show the structure of supply of the anode potential in Embodiment 1.
Figure 16:
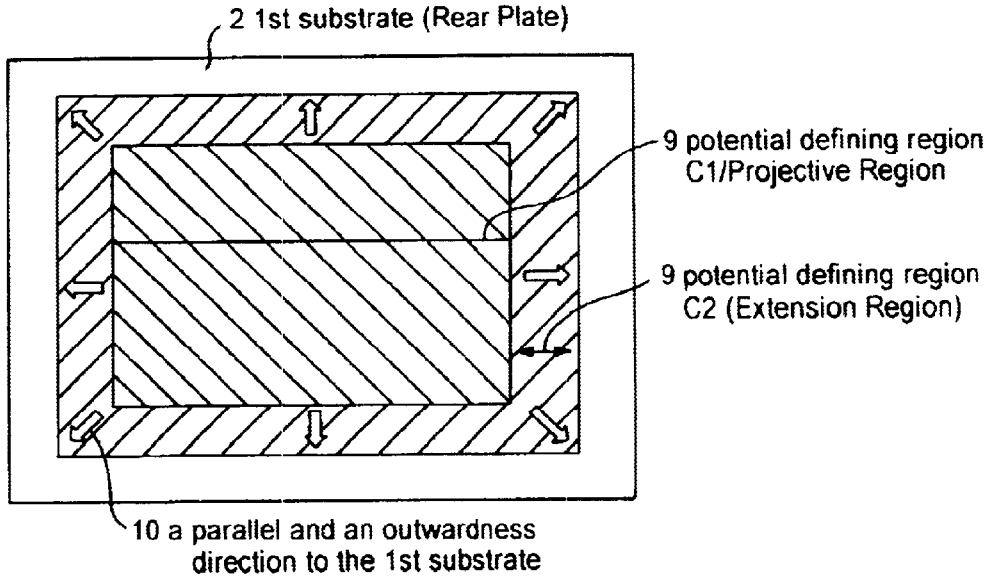
FIG. 16. depicts a perspective view of the image-forming apparatus according to this invention.

FIG. 15 shows a method of leading out a wire for supplying the anode potential in the present embodiment. FIG. 15 is a cross-sectional view along a diagonal line of the display panel of FIG. 1 and provides an enlarged view of one of the four corners of the support frame 4. Numeral 1518 designates a high-voltage introducing terminal for supplying the high voltage (anode voltage Va) to the image-forming member 1010. The introducing terminal 1518 is the terminal end of the potential defining electrode on the vacuum-side internal wall of the anode substrate, which consists of a conductor 1516 and an insulator 1517. At this time the insulator 1517 passes through an insulating layer 1513 and a protective film layer 1506 on the internal wall side and through a through hole in the rear plate glass. The other reference symbols denote the same members as those in FIG. 1.

Here the high-voltage leading-out method is not limited to the method described herein, but can be any method capable of leading the wire out through a certain insulating area in the potential-defining projective area of the cathode, for example, out of those disclosed in Japanese Patent Applications Laid-Open No. 10-321167 and No. 10-255692. It is desirable to implement the high-voltage leading-out through the above insulating structure in the potential defining area at the four corners in order to circumvent the leading-out areas of the row-directional wires and the column-directional wires for driving, in the potential defining area of the cathode.

In this structure, there is the possibility that discharge occurs along the side surface of the insulator 1517, and it is thus preferable to surround it by the low-resistance conductor 1506 as a protective film layer around the through hole 1507, as illustrated in FIG. 15, to prevent discharge current from flowing into the electron source and the vacuum vessel.

Another possible configuration is such that the high-voltage wire is drawn out on the face plate side. In that configuration, the voltage on the insulator is not so high and discharge is unlikely to occur. Therefore, it is a more preferable configuration in terms of prevention of discharge.

A potential defining film of $SnO_2$ is formed in a predetermined range (the range indicated by the dashed line in FIG. 1) of the part except for the electron-emitting devices 15 and the wires for electrically connecting them, in the surface of the cathode-side substrate or electron source 1, and the inside of this range is the potential defining region 9.

The potential defining region 9 on the cathode side is located in an area C defined as follows. As illustrated in FIG. 2, let d be the distance between the metal back 8 and the electron source 1, A be a maximum area actually irradiated with electrons emitted from the electron-emitting devices 15, on the metal back 8 of the anode-side potential defining region, B be an area where the anode-side potential defining region or metal back is placed, and C be the cathode-side potential defining area. Then normals are drawn from the outermost edge of this area B toward the electron source 1 to define an area surrounded by the normals. The area C is larger by d in all the directions parallel to the surface of the electron source 1 than the area surrounded by the normals. Namely, X-directional and Y-directional lengths of an area E illustrated in FIG. 2 are d (where each of the areas A, B, C, E, and F is indicated by an X-directional line in FIG. 2 but the same also applies to the Y-direction). It is noted that the potential defining region is also located at the four corner portions.

Further, the anode-side potential defining region 8 is located in an area larger by $2\alpha d$ in all the directions parallel to the potential-defined surface as the anode than the outermost edge of the area A being the maximum area which the electrons emitted from the electron-emitting devices 15 actually irradiate. Namely, X-directional and Y-directional lengths of an area F illustrated in FIG. 2 are 2αd. In the present embodiment the distance d is 5 mm between the electron source 1 and the metal back 8, and α is 0.6.

Each of the constitutive elements described above will be described below in detail.

Figure 3:
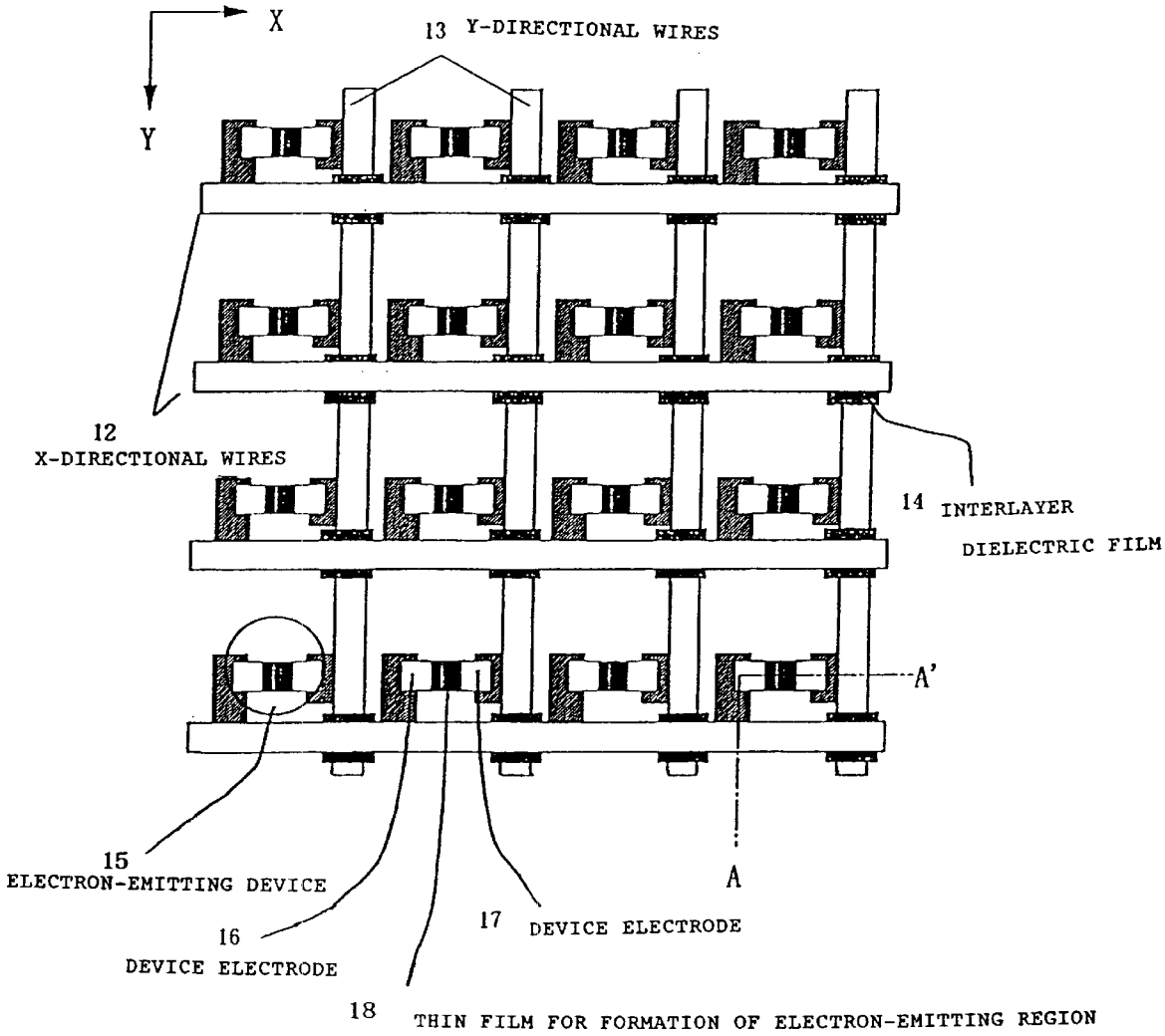
FIG. 3 is a plan view to show the principal part of the electron source in the image-forming apparatus illustrated in FIG. 1.
Figure 4:
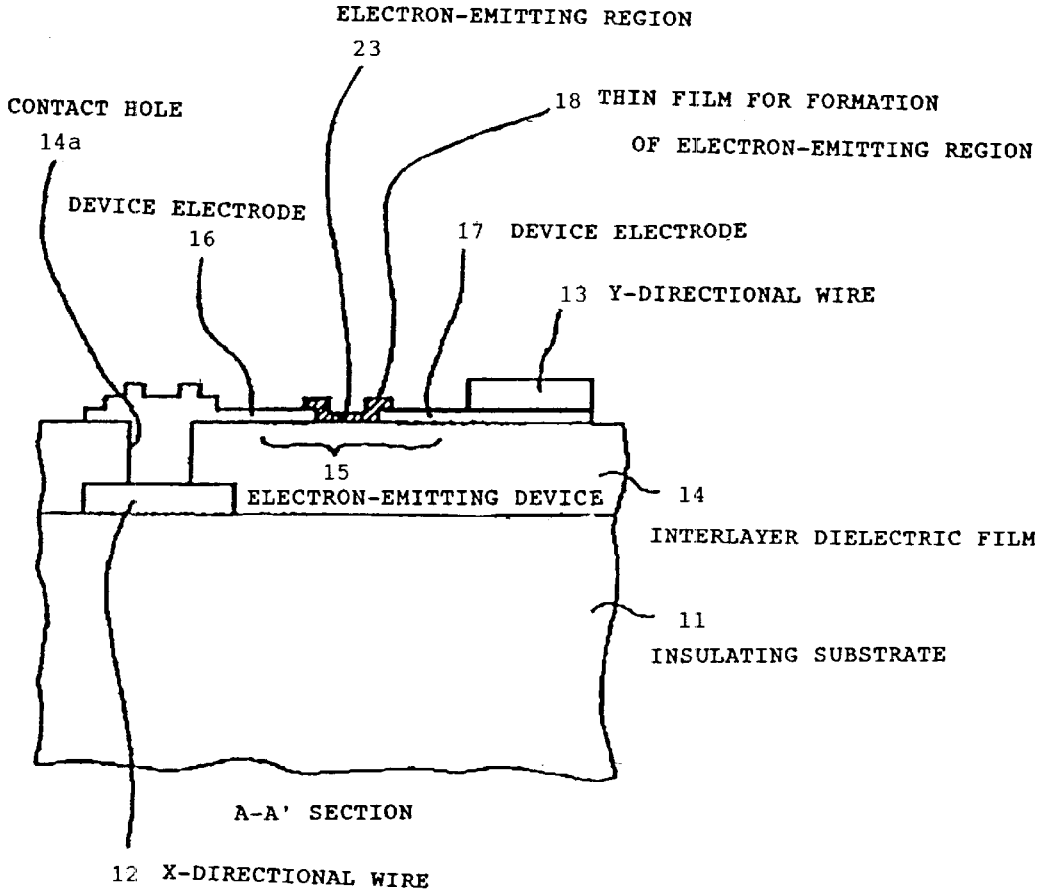
FIG. 4 is a cross-sectional view along the line A–A' of the electron source illustrated in FIG. 3.

FIG. 3 is a plan view to show the principal part of the electron source in the image-forming apparatus illustrated in FIG. 1 and FIG. 4 is a cross-sectional view along the line A–A' of the electron source illustrated in FIG. 3.

As illustrated in FIG. 3 and FIG. 4, m X-directional wires 12 and n Y-directional wires 13 are arranged in the matrix pattern while electrically being isolated from each other by interlayer dielectric films 14 on an insulating substrate 11 of a glass substrate or the like. A surface conduction electron-emitting device 15 is electrically connected between each X-directional wire 12 and each Y-directional wire 13.

Each electron-emitting device 15 is comprised of a pair of device electrodes 16, 17 placed with spacing in the X-direction and a thin film 18 for formation of the electron-emitting region, which connects the device electrodes 16, 17. Out of the pair of device electrodes 16, 17, one device electrode 16 is electrically connected through a contact hole 14*a* formed in the interlayer dielectric film 14, to the X-directional wire 12, while the other device electrode 17 is electrically connected to the Y-directional wire 13. Each of the device electrodes 16, 17 is made of an electroconductive metal or the like by vacuum evaporation, printing, sputtering, or the like.

The size and thickness of the insulating substrate 11 are properly determined depending upon the number of electron-emitting devices 15 placed on the insulting substrate 11 and the designed shape of the individual devices and depending upon conditions etc. for retaining the vessel in vacuum if the substrate constitutes part of the vessel upon use of the electron source 1.

Each X-directional wire 12 and each Y-directional wire 13 are made of a conductive metal or the like in a desired pattern by vacuum evaporation, printing, sputtering, or the like on the insulating substrate 11, and the material, film thickness, and wire width are determined so as to supply as uniform voltage to the many electron-emitting devices 15 as possible. The interlayer dielectric film 14 is a film of $SiO_2$ or the like made by vacuum evaporation, printing, sputtering, or the like, and is formed in a desired shape over the entire surface or in part of the insulating substrate 11 after formation of the X-directional wires 12. The film thickness, material, and production method of the film 14 are properly determined, particularly, so as to stand the potential difference at the intersections between the X-directional wires 12 and the Y-directional wires 13.

The X-directional wires 12 are electrically connected to an unrepresented scanning signal generator for applying a scanning signal for optional scan of a row of electron-emitting devices 15 arrayed in the X-direction. On the other hand, the Y-directional wires 13 are electrically connected to an unrepresented modulation signal generator for applying a modulation signal for optional modulation of each column of electron-emitting devices 15 arrayed in the Y-direction. Here a driving voltage applied to each electron-emitting device 15 is supplied as a difference voltage between the scanning signal and the modulation signal applied to the device of interest.

Figure 5:
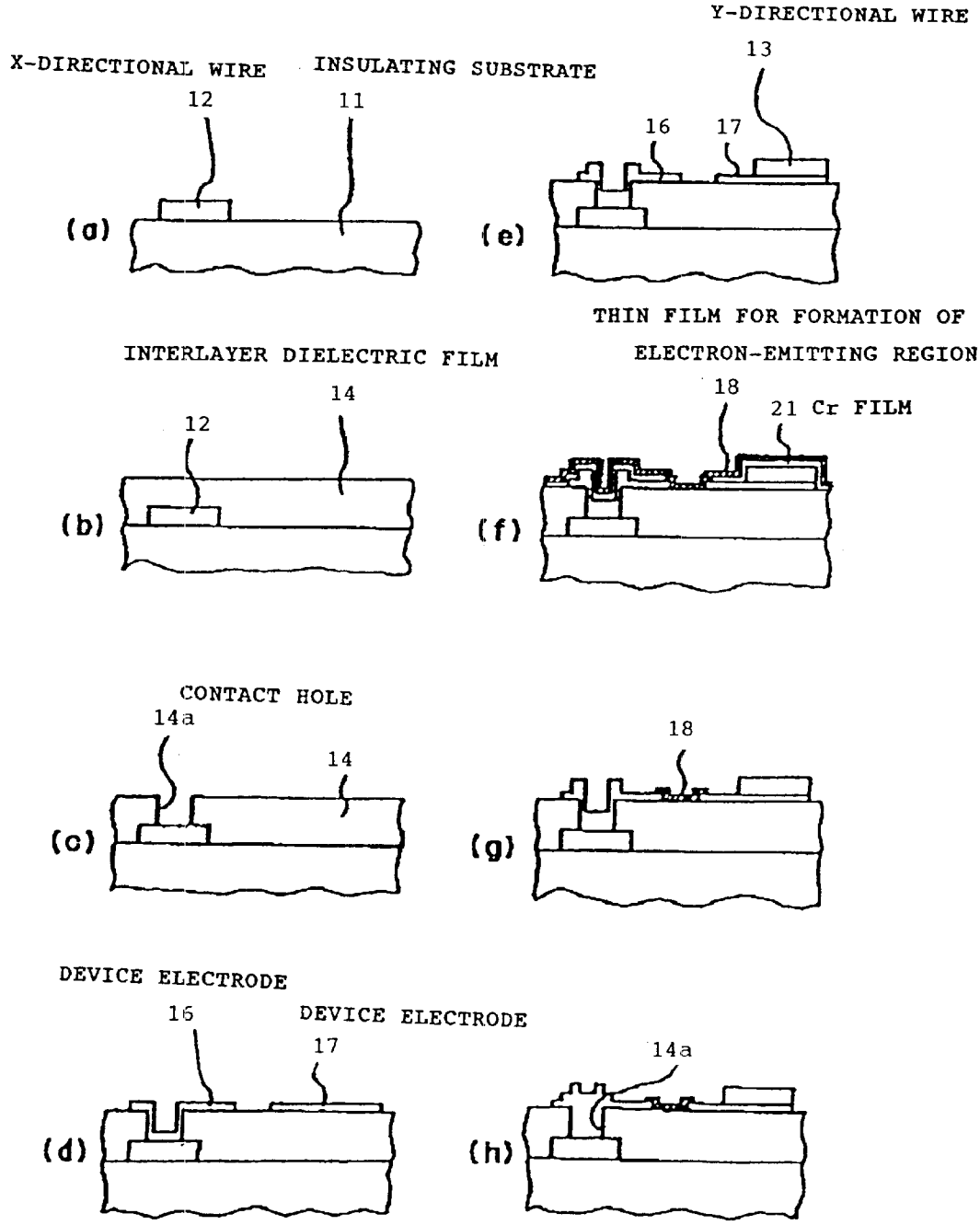
FIG. 5 is a diagram to show a sequence of production steps of the electron source in the image-forming apparatus illustrated in FIG. 1.

Now, an example of the production method of the electron source 1 will be described specifically according to the sequence of steps illustrated in FIG. 5. The following steps a to h correspond to (a) to (h) of FIG. 5.

Step-a

On the insulating substrate 11, which was made by forming a silicon oxide film 0.5 μm thick on cleaned soda lime glass by sputtering, layers of Cr 50 Å thick and Au 6000 Å thick are successively laid by vacuum evaporation and thereafter a photoresist (AZ1370 available from Hoechst Inc.) is applied thereonto by spin coating with a spinner. After baking it, a photomask image is exposed and developed to form a resist pattern of the X-directional wires 12 and the Au/Cr deposited films are wet-etched to form the X-directional wires 12 in the desired shape.

Step-b

Next, the interlayer dielectric film 14 of silicon oxide film is deposited in the thickness of 0.1 μm by RF sputtering.

Step-c

A photoresist pattern is made for forming the contact holes 14*a* in the silicon oxide film deposited in the above step b and, using it as a mask, the interlayer dielectric film 14 is etched to form the contact holes 14*a*. The etching is conducted according to the RIE (Reactive Ion Etching) process using $CF_4$ and $H_2$ gases.

Step-d

After that, a pattern to become the gaps between the device electrodes is formed with a photoresist (RD-2000N-41 available from Hitachi Chemical Co., Ltd. (Hitachi Kasei Kogyo)) and layers of Ti and Ni are successively deposited in the thickness of 50 Å and in the thickness of 1000 Å, respectively, by vacuum evaporation. The photoresist pattern is dissolved with an organic solvent and the Ni/Ti deposited films are subjected to lift-off to form the device electrodes 16, 17 having the device electrode gap L1 (see FIG. 6) of 3 μm and the device electrode width W1 (see FIG. 6) of 300 μm.

Step-e

A photoresist pattern of the Y-directional wires 13 is formed on the device electrodes 16, 17 and thereafter layers of Ti and Au are successively deposited in the thickness of 50 Å and in the thickness of 5000 Å, respectively, by vacuum evaporation. Then unnecessary portions are removed by lift-off to form the Y-directional wires 13 in the desired shape.

Step-f

Figure 6:
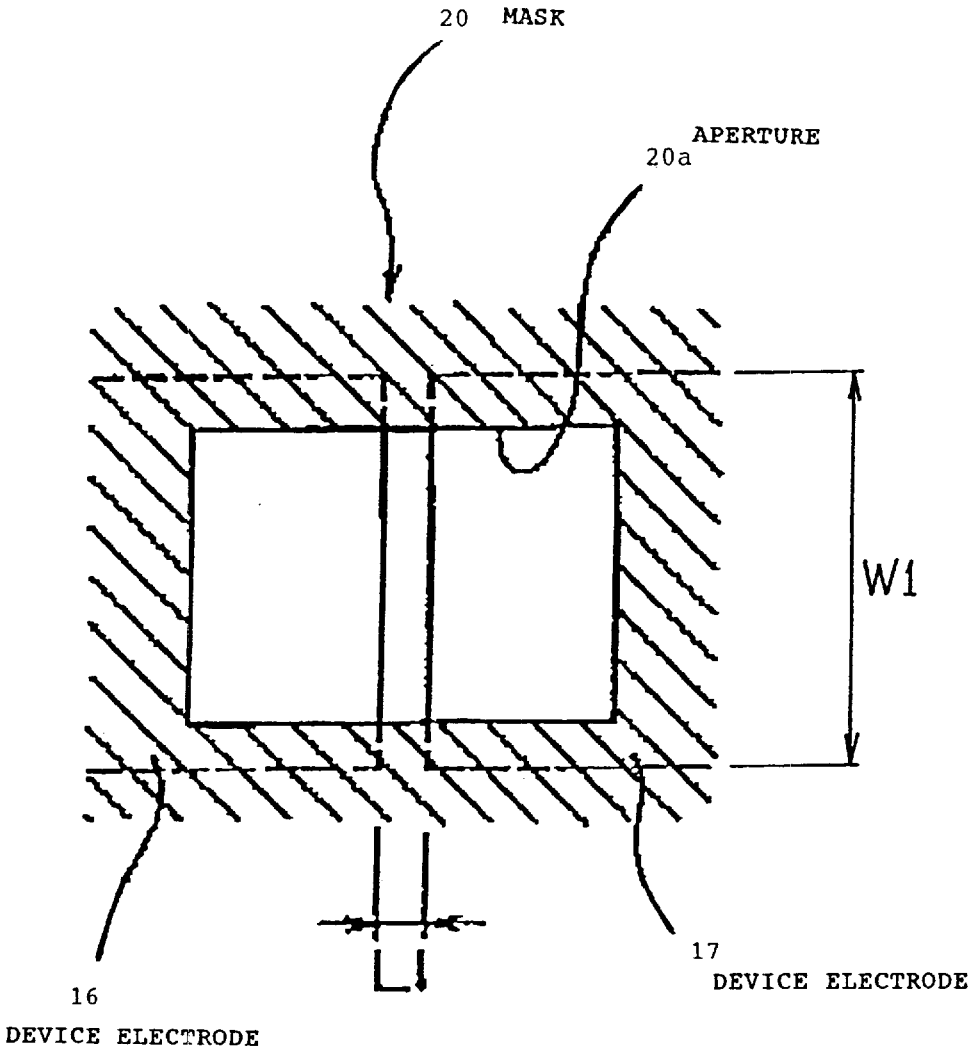
FIG. 6 is a plan view to show an example of a mask used in forming a thin film for formation of the electron-emitting region.

Using a mask 20 with apertures 20a bridging each pair of device electrodes 16, 17 located with the clearance of device electrode gap L1 as illustrated in FIG. 6, a Cr film 21 is deposited and patterned in the thickness of 1000 Å by vacuum evaporation and organic Pd (ccp4230 available from Okuno Seiyaku K.K.) is applied thereonto by spin coating with a spinner. Then it is baked at 300° C. for ten minutes.

The thin film 18 for formation of electron-emitting regions containing the principal element of Pd, formed in this way, had the film thickness of about 100 Å and the sheet resistance of $5\times10^4$ Ω/□.

Step-g

The Cr film 21 is removed with an acid etchant to form the thin film 18 for formation of electron-emitting regions in the desired pattern shape.

Step-h

A pattern is formed so as to coat the portions except for the portions of contact holes 14*a* with a resist and layers of Ti and Au are successively deposited in the thickness of 50 Å and in the thickness of 5000 Å, respectively, by vacuum evaporation. Unnecessary portions are removed by lift-off to fill the contact holes 14*a*.

Through the above steps, the X-directional wires 12, Y-directional wires 13, and electron-emitting devices 15 are two-dimensionally arranged at equal intervals on the insulating substrate 11.

After that, an $SnO_2$ film (potential defining film) is evaporated by ion plating with a mask patterned so that the surface resistance becomes about $1\times10^{11}$ Ω/□ in the exposed portions of the interlayer dielectric film 14, i.e., in the portions not covered by the X-directional wires 12, Y-directional wires 13, device electrodes 16, 17, and the thin films 18 for formation of electron-emitting regions, thereby obtaining the X-directional wires 12, Y-directional wires 13, device electrodes 16, 17, the thin films 18 for formation of electron-emitting regions, and the potential defining region 9 of the potential defining film. The thickness of the potential defining film is 1000 Å. The potential defining film is kept in contact with the X-directional wires and the Y-directional wires so that the potential thereof is defined through the wires.

The size of the potential defining region 9 is set to be greater by 11 mm in the X-direction and in the Y-direction from the outermost electron-emitting regions 23, where the distance d (see FIG. 2) is 5 mm between the electron source 1 and the metal back 8, based on the experimental result that the electrons emitted from the electron-emitting regions 23 (see FIG. 4) deviate about 1 mm from the normal direction to the surface of the electron source 1 under the driving conditions described hereinafter.

The electron source 1 produced in this way is fixed on the rear plate 2 with frit glass and set inside the envelope, and the envelope is evacuated through an unrepresented exhaust pipe by a vacuum pump. After a sufficient vacuum is established, the voltage is applied through external terminals Dx1 to Dxm and Dy1 to Dyn between the device electrodes 16, 17 of the electron-emitting devices 15 to effect the energization process (forming process) of the thin films 18 for formation of electron-emitting regions, thereby locally breaking the thin films 18 for formation of electron-emitting regions to form the electron-emitting regions 23 (see FIG. 4) in the thin films 18 for formation of electron-emitting regions.

Figure 7:
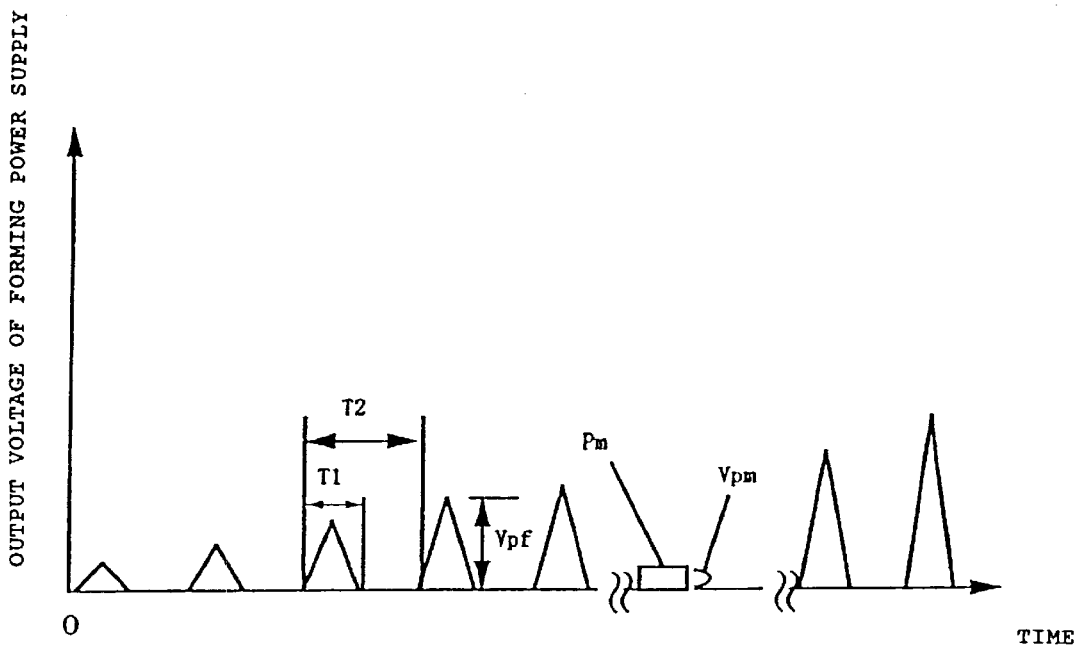
FIG. 7 is a diagram to show an example of voltage waveform used in the forming process.

For example, the forming process can be an operation of placing the triangular wave having the pulse width T1 of 1 msec and the peak height (peak voltage upon forming) of 5 V, as illustrated in FIG. 7, at the pulse separation T2 of 10 msec for 60 seconds under the vacuum atmosphere of $1.3\times10^{-4}$ Pa to locally break the thin films 18 for formation of electron-emitting regions, whereby the electron-emitting regions 23 can be formed in the thin films 18 for formation of electron-emitting regions.

The electron-emitting regions 23 formed in this way were in a state in which fine particles containing the principal component of palladium element were dispersed, and the average particle size of the fine particles was 30 Å.

Figure 8:
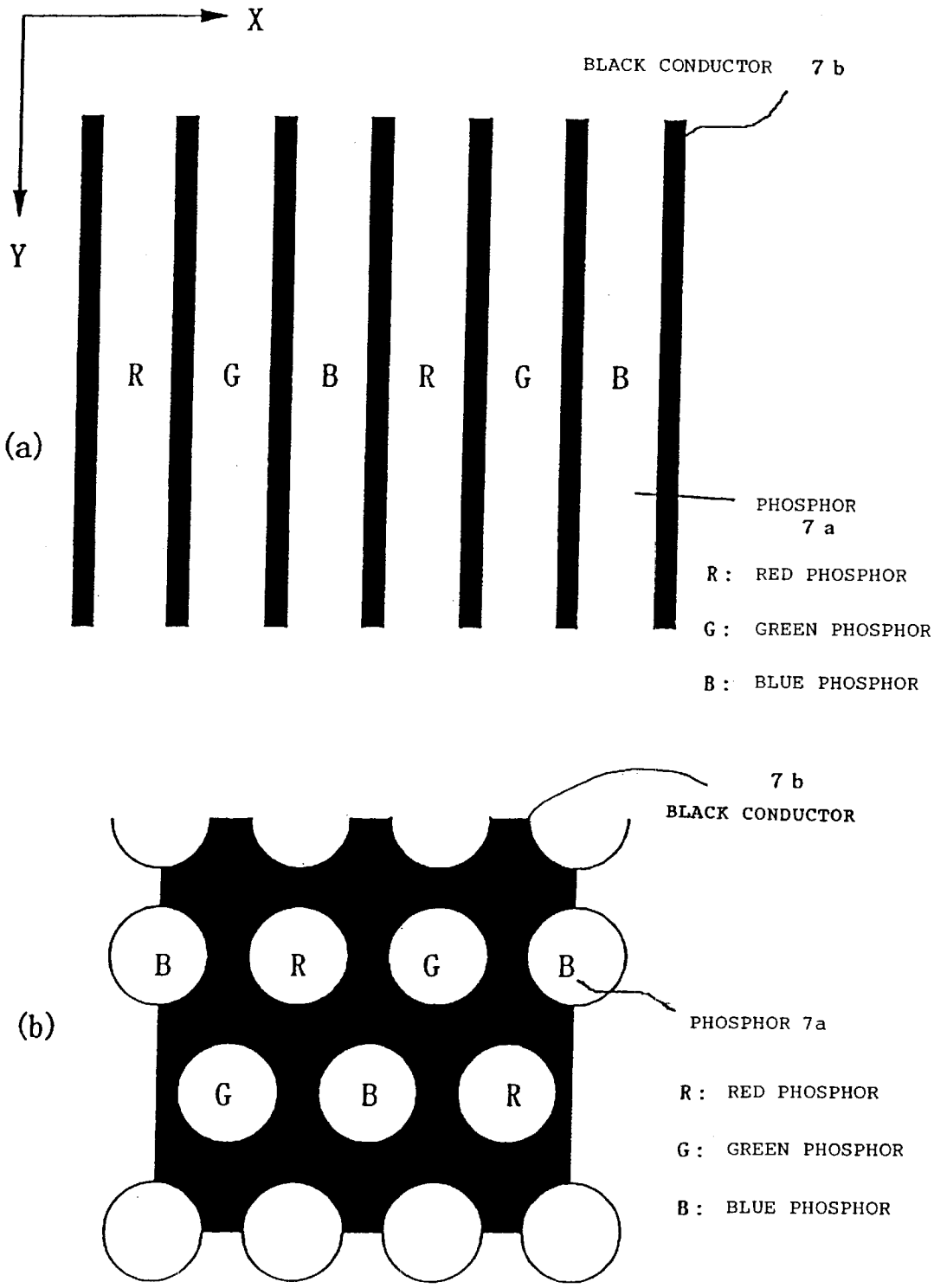
FIG. 8 is a diagram for explaining the structure of fluorescent film.

The fluorescent film 7 consists of only a phosphor in the monochrome case, but in the color case it consists of fluorophors 7*a* and a black conductor 7*b* called black stripes or a black matrix depending upon arraying methods of the phosphor, as illustrated in FIG. 8.

Since the phosphor 7*a* need to be placed corresponding to the electron-emitting devices 15, it is necessary to effect accurate alignment between the face plate 3 and the rear plate 2 in construction of the envelope. The purposes of provision of the black stripes or the black matrix are to make mixture of colors unobstructive among the fluorophors of the three primary colors necessary for the color display by blacking intermediate regions between the phosphor 7*a* and to restrain decrease of contrast due to reflection of external light at the fluorescent film 7.

A material for the black conductor 7*b* can be either of commonly used materials mainly containing graphite and can also be any material with electric conductivity but with little transmission and reflection of light. A method of coating the glass substrate 6 with the fluorophors 7*a* can be either a precipitation method or a printing method in the both monochrome and color cases.

The purposes of the metal back 8 are to enhance the luminance by specular reflection of light traveling toward the internal surface side out of the fluorescence from the fluorophors 7*a*, back toward the face plate 3, to act as the acceleration electrode for applying the electron-beam accelerating voltage, to protect the phosphor 7*a* from damage due to collision of negative ions generated in the envelope, and so on.

The metal back 8 can be made by a method of first forming the fluorescent film 7, then carrying out a smoothing operation (normally called filming) of the inside surface of the fluorescent film 7, and thereafter depositing Al thereon by vacuum evaporation or the like. The face plate 3 may be further provided with a transparent electrode (not illustrated) of ITO or the like between the fluorescent film 7 and the glass substrate 6 in order to enhance electric conductivity of the fluorescent film 7.

The envelope is in communication with an unrepresented exhaust pipe and is sealed after evacuated to the vacuum of about $1.3\times10^{-4}$ Pa. Therefore, the rear plate 2, face plate 3, and support frame 4 constituting the envelope are desirably those capable of maintaining the vacuum atmosphere against the atmospheric pressure exerted on the envelope and having the electric insulation enough to resist the high voltage applied between the electron source 1 and the metal back 8.

The materials for them can be ceramic materials and the like, for example, such as silica glass, glass with a reduced impurity content of Na or the like, soda lime glass, alumina, and so on. However, the face plate 3 needs to be made of a material with transmittance over a certain level for the visible light. It is preferable to combine materials having coefficients of thermal expansion close to each other.

The sealing between the face plate 3 and the support frame 4 with frit glass and the sealing between the rear plate 2 and the support frame 4 with frit glass are conducted in such a manner that the frit glass is applied onto their joint portions and baked at 400–500° C. for ten or more minutes in the atmosphere or in a nitrogen atmosphere.

On the other hand, since the rear plate 2 is provided for the principal purpose of enhancing the strength of the electron source 1, the rear plate 2 is unnecessary where the electron source 1 itself has sufficient strength; in that case, the support frame 4 is directly sealed to the electron source 1 and the envelope is composed of the electron source 1, the support frame 4, and the face plate 3.

A getter process can be performed in order to maintain the vacuum degree after the sealing of the envelope in certain cases. This is a process of forming an evaporated film by heating getters placed at predetermined positions (not illustrated) inside the envelope by resistance heating or high-frequency heating or the like immediately before or after the sealing of the envelope. The principal component of the getters is normally Ba and is one capable of maintaining, for example, the vacuum degree of $1.3\times10^{-3}$ Pa to $1.3\times10^{-5}$ Pa by the adsorption action of the evaporated film.

Next, the operation of the present embodiment will be described below.

When the voltage is applied through the external terminals Dx1 to Dxm and Dy1 to Dyn to each electron-emitting device 15, the electron-emitting region 23 emits electrons.

At the same time as it, the high voltage of 5 kV is applied through the high-voltage terminal Hv to the metal back 8 (or an unrepresented transparent electrode) to accelerate the electrons emitted from the electron-emitting regions 23 and make the electrons collide with the inner surface of the face plate 3. This excites the phosphor 7*a* of the fluorescent film 7 (see FIG. 8) to cause emission of light, whereupon an image is displayed.

Incidentally, it is required that the acceleration voltage be high enough to assure the emission luminance in the plane type image-forming apparatus provided with the acceleration electrode as the anode, including the present embodiment. Therefore, the voltage placed between the metal back 8 of the anode and the potential defining region 9 of the cathode can be even approximately 20 kV in the highest case, so that the electric field can be 1 kV/cm to several ten kV/cm in the area where the parallel electric field is established in the gap between the anode and the cathode.

However, this spatial symmetry as in the gap between the two electrodes is lost in the outermost areas of the anode and cathode and the electric field there is bent from the parallel state. Particularly, the field concentration occurs in the border areas between the anode/cathode and the insulating members, so that the electric field is locally concentrated to approximately 1.3 times that in the gap inside. The field emission due to the field concentration is normally problematic with the electron emission from the cathode side in most cases.

Therefore, the field concentration at the cathode-side edge is relaxed in the structure in which the voltage-applied portion of the anode does not exist immediately above the cathode end side when viewed therefrom and the anode is thus relatively smaller than the cathode. Further, when the anode edge part is located at least the anode-cathode distance d more inside or smaller on the field-applied area side in the projective plane onto the cathode than the cathode edge part, the anode-cathode distance at the edge part is substantially restrained by $1/(2)^{1/2}$, so that the field concentration on the cathode side can be relaxed to the level in which it is not problematic. The distance between the projective borders at the edge parts of the anode and cathode can be set larger than d, of course, if the field concentration on the cathode side is relaxed.

Figure 10:
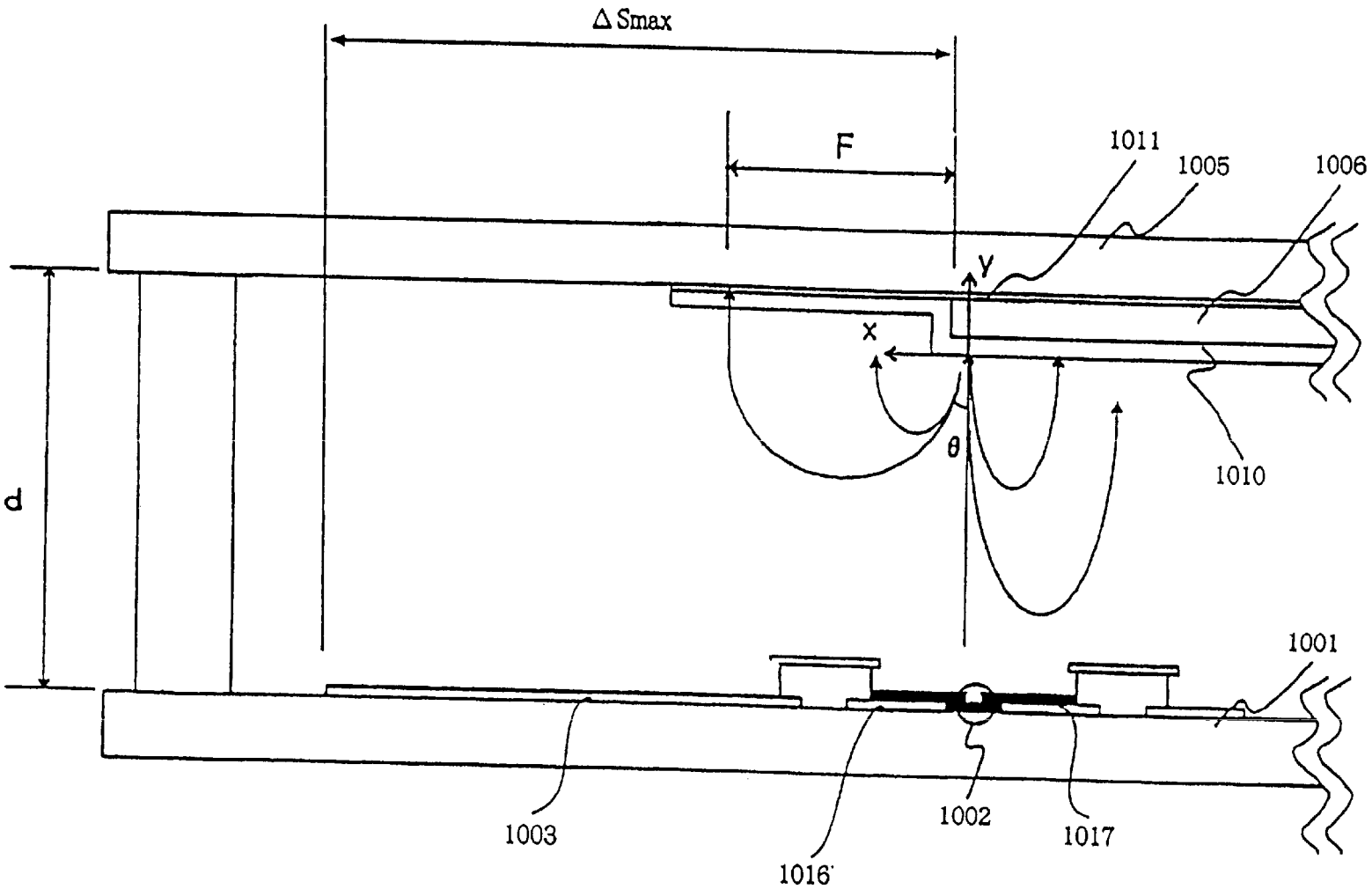
FIG. 10 is a schematic, cross-sectional view of the anode side in the first embodiment of the image-forming apparatus of the present invention.
Figure 11:
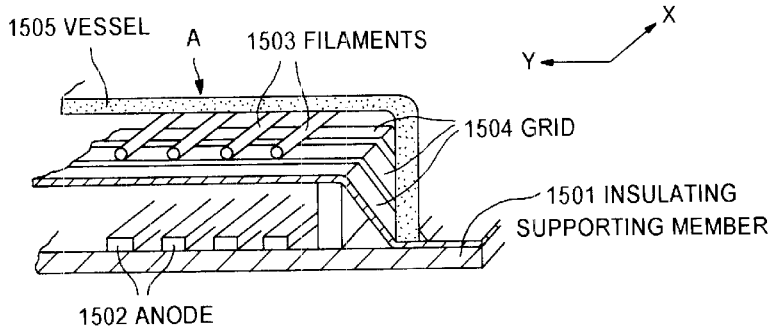
FIG. 11 PRIOR ART
FIG. 11 is a schematic, structural diagram of the conventional image-forming apparatus using the thermionic emission source.
Figure 12:
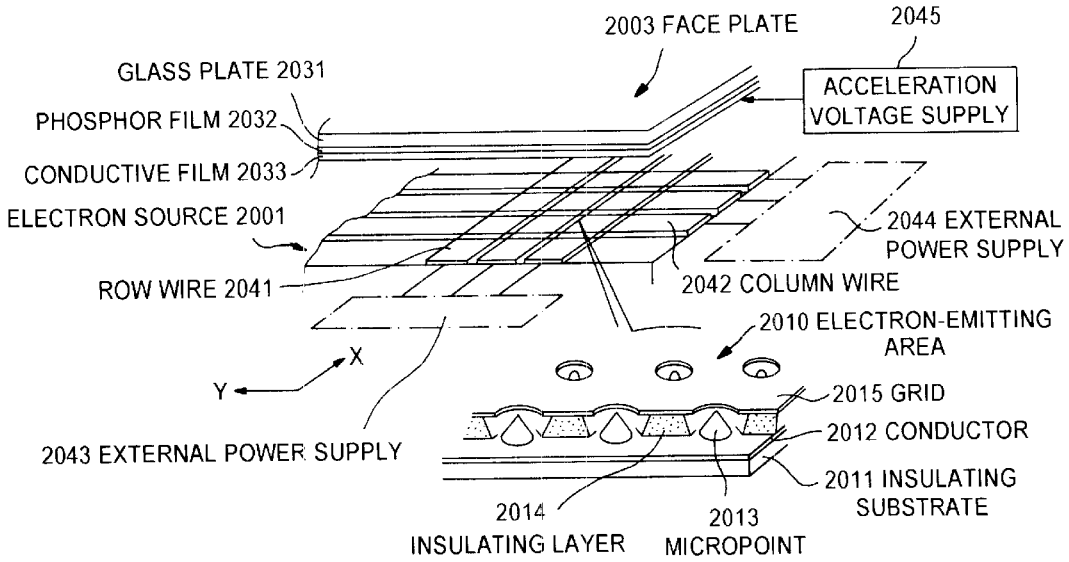
FIG. 12 PRIOR ART
FIG. 12 is a schematic, structural diagram to show the conventional image-forming apparatus using the field emission type electron source, partly enlarged.
Figure 13:
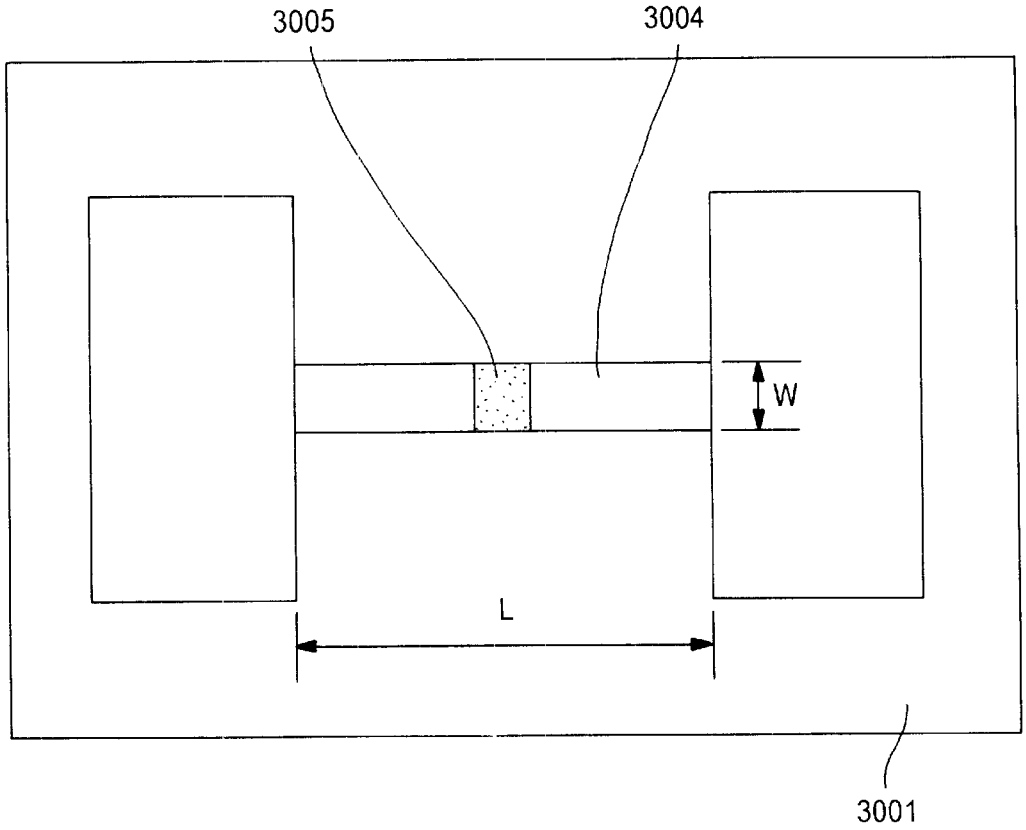
FIG. 13 PRIOR ART
FIG. 13 is a diagram to show the typical device structure of the surface conduction electron-emitting device.

Next, FIG. 10 shows an enlarged detail diagram of the face plate structure in order to explain a more preferable configuration of layout of the anode and cathode according to the present invention. In FIG. 10, numeral 1005 designates the face plate 1005 of soda lime glass in which the fluorescent body 1006, covered with the ITO film of transparent conductive film 1011 provided for increasing the electric conductivity and with the metal back 1010 of thin film of aluminum, is placed on the internal surface of the panel.

The figure schematically shows a state in which primary electrons emitted from an electron-emitting device 1002 in the outermost periphery are scattered backward at angles of θ to the direction of incidence and in which the backwardly scattered electrons are again accelerated by the parallel electric field. Letter d represents the distance between the face plate 1005 and the rear plate 1001 and is substantially equal to the distance between the anode and the cathode. Letter F indicates the distance from the peripheral edge of the fluorescent body 1006 irradiated with the primary electron beams to the edge of the metal back 1010 and the ITO film 1011 of conductors.

As illustrated in FIG. 10, the origin is set at the point on the aluminum metal back 1010 where the primary electron beam is incident, and the x-axis and y-axis are taken as illustrated. Then trajectories of electron beams scattered backward at the backward scattering angle e are expressed as follows.

$$x = Vo \cdot t \cdot \sin\theta$$

$$y = e \cdot Ey / 2m \times t^2 - Vo \cdot t \cdot \cos\theta$$

In these equations, Vo represents an absolute value of velocity of each backwardly scattered electron immediately after the backward scattering, and e and m the charge and mass of the electron. Further, Ey and t are the y-directional field intensity and time, respectively. The parallel electric field is assumed herein and thus the field intensity in the x-direction Ex=0.

Next, let us find the distance x(θ)=F up to the landing (y=0) with reacceleration of the electron beam by the electric field. For obtaining it, the following relations are used to be substituted into the above equations.

$$Vo = ((2\alpha \cdot e \cdot Va)/m)^{1/2}$$

$$Ey = Va/d$$

Then the resultant equations are modified to obtain the following.

$$F(\theta) = 2\alpha \cdot d \cdot \sin 2\theta$$

In the above equations, α and Va represent an energy ratio of the primary electron beam to the backwardly scattered electron beam and the acceleration voltage of the primary electron beam applied to the face plate, respectively. The ratio α is greatly dependent upon the material, shape, structure, etc. of the member to which the primary electron beam is incident, and α=0.6 to 1 in general.

The distance F takes a maximum value represented by the following equation at θ=π/4.

$$F = 2\alpha d$$

Namely, it is seen that the backwardly scattered electrons in the peripheral area again land within the maximum distance of 2α·d from the peripheral edge.

Based on the above consideration, the electric conductor is placed at or over 2α·d from the peripheral edge of the image-forming region and the side wall part is located further outside thereof, whereby the backwardly scattered electrons can be prevented from colliding with the insulating portions or the side wall part of glass or the like outside the image display area. Then this decreases the charging and discharge due to the emission of secondary electrons, the emission of gas, etc., permits attainment of higher definition/higher color purity of the plane type image-forming apparatus, and then improves the reliability as a device.

Next, description will be given using FIG. 10 as an enlarged detail diagram of the rear plate structure in order to explain the more preferable configuration of layout of the anode and cathode according to the present invention. The names of the respective portions are according to those in FIG. 1.

The fluorescent film 1006 emits light when the electrons emitted from the electron-emitting regions 1002 collide with the internal surface of the face plate 1005. In addition to this light emission phenomenon, there also occur phenomena of ionization and scattering of particles attached to the fluorescent film 1006 and to the metal back 1010. Among these scattered particles, positive ions are accelerated toward the electron source 1003 by the voltage applied to the metal back 1010 and fly along parabolic trajectories according to initial velocities thereof in the direction normal to the electric field.

Let Va be the potential difference between the electron source 1003 and the metal back 1010, eVi [eV] be the maximum of horizontal initial kinetic energy of the positive ions, m [kg] be the mass of each positive ion, +q [C] be electric charge thereof, vin be the initial velocity in the vertical direction, and vit be the initial velocity in the horizontal direction. Then the following equations represent the time t necessary for a positive ion appearing in the surface of the metal back 1010 to reach the electron source 1003 the distance d apart, and the moving distance ΔS in the direction parallel to the surface of the electron source 1003.

$$Vin \cdot t + q \cdot Va/(2m \cdot d) \times t^2 = d \quad (1)$$

$$Vi = (Vin^2 + Vit^2)/2m \quad (2)$$

$$\Delta S = Vit \times t \quad (3)$$

At this time, the maximum travel range as a condition for the positive ions is given under the following conditions (4) and (5).

$$q = +1e\ [C] \quad (4)$$

$$Vin = 0\ [m/s] \quad (5)$$

At this time the maximum range is as follows.

$$\Delta Smax = 2d \times (Vit/Va)^{1/2} \quad (6).$$

In the present embodiment, since the total thickness of the metal back 1010 and the fluorescent film 1006 is not more than about 50 μm, there arises no practical problem when the distance d between the electron source 1003 and the metal back 1010 is replaced by the distance between the rear plate 1001 and the face plate 1005.

Supposing a positive ion generated in the surface of the metal back 1010 accepts all the energy of the voltage applied to the metal back 1010 and jumps out in the horizontal direction parallel to the surface of the electron source 1003, the moving distance ΔS of this positive ion up to the arrival at the electron source 1003 is determined as follows by substituting Va into Vi in Eq. (6).

$$\Delta Smax = 2d \quad (7)$$

Namely, the region where the positive ions generated in the surface of the metal back 1010 can arrive is defined within the range of the radius 2*d* around the intersecting points between the electron source 1003 and normals, which are normals to the surface of the electron source 1003 from the positions where the electrons actually collide on the metal back 1010, on the internal surface of the electron source 1003.

Therefore, if the potential is defined within the range at least satisfying Eq. (7), there will exist no instable potential surface in the flying directions of the positive ions generated in the surface of the metal back 1010, whereby the electron source 1 will be prevented from being charged thereby.

In the present embodiment, as described above, the cathode-side potential defining region (1003) is placed at least d horizontally and outside of the anode-side potential defining region (1010) and the anode-side potential defining region 1010 is placed up to the point at least 1.2d apart horizontally and outside from the electron-irradiated area (1006) similarly; therefore, the cathode-side potential defining region 1003 ranges from the irradiated area (1006) to 2.2d outside, so that the range of this potential defining region (1003) satisfies Eq. (7). Of course, the size of the potential defining region (1003) can be set to a larger area than the above-stated region, because the potential is defined within the range satisfying Eq. (7).

The resistivity of the potential defining film forming the potential defining region (1003) is relatively high, but the rate of the area of the potential defining film to the whole of the potential defining region (1003) is within 30%. Thus it is sufficient to define the potential, because the other portions are covered with electric conductors having sufficiently low resistivity, such as the electrodes etc. of metal. Namely, all of the potential defining region (1003) does not have to be made of the conductive material with low resistivity, and it can be made of a combination of a low-resistivity material with a high-resistivity material. In this case, it is preferable to make 50% or more of the area of the potential defining region (1003) of a conductive material with the surface resistivity of not more than $1\times10^5$ Ω/□ and make the rest part of a conductive material with the surface resistivity of not more than $1\times10^{12}$ Ω/□.

As described above, no charging occurred in the inner surface of the face plate 1005 by the provision of the potential defining region (1003) on the cathode-side substrate and it stabilized the trajectories of electrons emitted from the electron-emitting regions 1002, whereby an excellent image was obtained without positional deviation. The probability of occurrence of discharge or the like was also extremely low and the image-forming apparatus was obtained with high reliability.

In ordinary cases, the applied voltage between the paired device electrodes 1016, 1017 of the electron-emitting devices 1015 is about 12 to 16 V, the distance d between the metal back 1010 and the electron source 1003 is about 2 mm to 8 mm, and the applied voltage Va to the metal back 8 is about 1 kV to 10 kV. In the present embodiment, the applied voltage between the paired device electrodes 1016, 1017 was 14 V, the distance between the metal back 1010 and the electron source 1 was 5 mm as described above, and the applied voltage Va to the metal back 8 was 5 kV.

Figure 9:
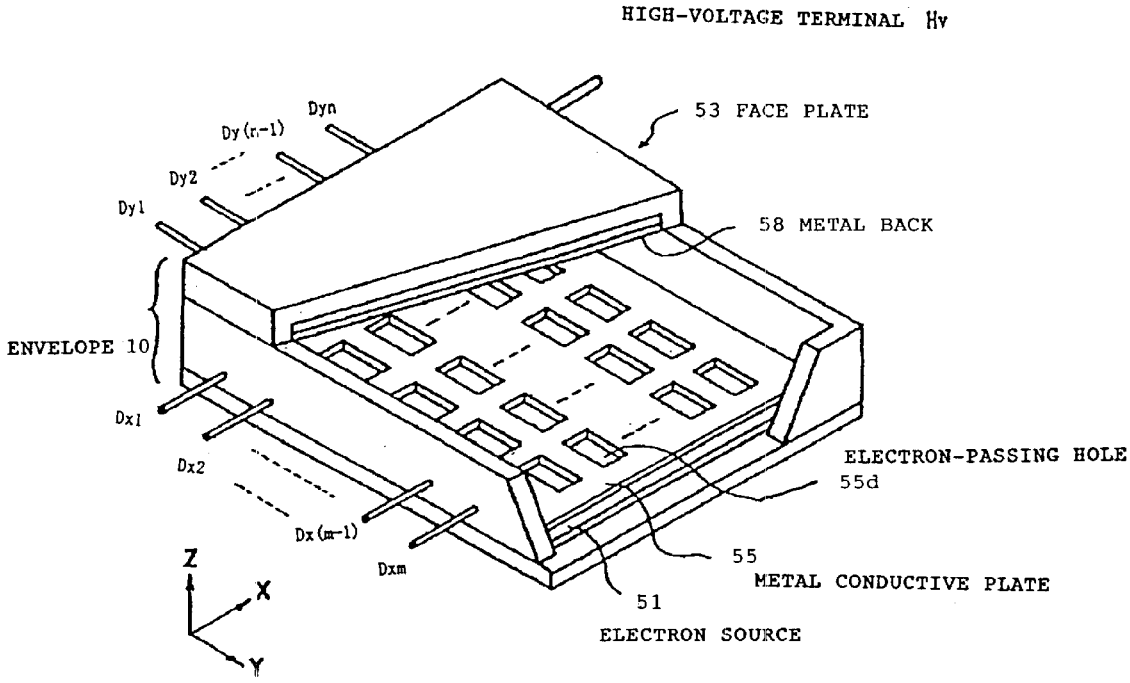
FIG. 9 is a perspective view of the second embodiment of the image-forming apparatus of the present invention, partly broken.

FIG. 9 is a perspective view of the second embodiment of the image-forming apparatus of the present invention, partly broken. The present embodiment is different from the first embodiment in that a metal conductive plate 55 is placed through insulating support poles (not illustrated) having the thickness of about 100 μm on the electron source 51, instead of forming the potential defining film on the surface of the electron source 51.

The metal conductive plate 55 is a metal sheet about 100 μm thick, in which electron-passing holes 55*a*, which permit electrons emitted from a plurality of electron-emitting devices (not illustrated) on the electron source 51 to pass, are formed corresponding to the respective electron-emitting devices.

The distance is 5 mm between the metal back 58 of the face plate 53 and the metal conductive plate 55 and the size of the metal conductive plate 55 is made greater by 11 mm in the X-direction and in the Y-direction than the electron-emitting region of the outermost electron-emitting devices.

An appropriate voltage not to impede collision of electrons from the electron-emitting devices with the internal surface of the face plate 53 is applied from an external power supply (not illustrated) to the metal conductive plate 55 and the potential defining region is comprised of this metal conductive plate 55 and the electrodes of the electron-emitting devices on the electron source. The other structure and driving conditions are similar to those in the first embodiment and thus the description thereof is omitted herein.

The effect similar to that of the first embodiment can also be achieved by placing the metal conductive plate 55 at the position apart from the electron source 51 and constructing part of the potential defining portion of the metal conductive plate 55 as described above.

The embodiment described above present the effect described below.

The electron beam emitting apparatus of the present embodiment is constructed in the structure wherein the voltage-applied portion of the anode is not present immediately above the cathode edge when observed from the cathode edge side, so that the anode is relatively smaller than the cathode, which relaxes the field concentration at the cathode-side edge; further, the apparatus has the structure wherein the anode edge part is located at least the anode-cathode distance d more inside or smaller on the field-applied area side in the projective plane to the cathode than the cathode edge part, whereby the anode-cathode distance at the edge parts is increased by substantially $2^{1/2}$ times that in the parallel edge state and thus the local electric field near the anode at the edge part is restrained by $1/(2)^{1/2} \cong 0.7$ times; this can relax the field concentration at the edge part where the local field on the cathode side was increased to about 1.3 times in the conventionally ordinary structures in which the anode and cathode potential defining regions had approximately equal areas, to an acceptable level, i.e., to approximately $1.3 \times 0.7 \cong 0.9$ times. In this case, for example, the potential defining region can be formed in contact on the electron source or the potential defining region can be formed between the electron source and the electron-irradiated member.

In the case where it is impossible to make the entire potential defining region of a conductor with low resistivity, charging of the electron source can be fully prevented by the structure in which the area equal to 50% or more of the total surface area of the potential defining region is made of a conductor with the surface resistance of not more than $1 \times 10^5$ Ω/□ and the rest area of a conductor with the surface resistance of not more than $1 \times 10^{12}$ Ω/□.

Further, in the above electron beam emitting apparatus, the acceleration electrode is of the structure in which it encloses the irradiated area which the electrons emitted from the electron-emitting devices irradiate and the acceleration electrode ranges to the position of the distance F represented by the below equation in all the directions parallel to the second substrate when observed from the irradiated area; this further achieves such an effect that, during reentry of reflected electrons generated in the electron-irradiated area or the image-forming region onto the anode, it is feasible to restrain some electrons from entering the insulating surfaces and charging the second substrate including the anode.

$$F = 2\alpha d$$

In this equation, a represents a parameter depending upon the structure of the irradiated member on the face plate and $\alpha = 0.6$ to 1.0.

Further, the above placement of the two potential defining regions of the cathode and anode presents the effect of restraining the charging of the cathode-side insulating members, which can occur when the positively charged particles generated with irradiation of electrons from the electron irradiated region or image-forming region on the anode are incident to the cathode.

Use of the cold cathode type electron-emitting devices as the electron-emitting devices permits construction of the power-saving, quick-response-speed, and large-scale electron beam emitting apparatus. Among others, particularly, the surface conduction electron-emitting devices are simple in the device structure and easy in the layout of plural devices and thus the use of the surface conduction electron-emitting devices permits attainment of simple-structure and large-scale electron beam emitting apparatus.

Further, a plurality of surface conduction electron-emitting devices are arranged in the two-dimensional matrix and are connected by the plurality of row-directional wires and the plurality of column-directional wires and electron emission amounts can be controlled by selecting a lot of surface conduction type electron-emitting devices while supplying appropriate driving signals to the row-directional wires and to the column-directional wires; therefore, the electron source can be readily constructed on a single substrate, basically without need for addition of another control electrode.

The present invention was described above with the specific examples.

The present invention permits realization of the suitable electron beam emitting apparatus.

Since the image-forming apparatus of the present invention is constructed using the electron beam emitting apparatus of the present invention, the trajectories of electrons are stable and an excellent image can be formed without deviation of light-emitting positions as described above. Particularly, the use of the surface conduction electron-emitting devices as the electron-emitting devices permits attainment of the image-forming apparatus of the simple structure and the large screen.

INDUSTRIAL UTILIZATION

The present invention can be applied in the field of the electron beam emitting apparatus such as the image-forming apparatus.

What is claimed is:

1. An electron beam emitting apparatus comprising a first plate in which an electron-emitting device is provided, and an electrode opposed to a surface of the first plate on which said electron-emitting device is provided, the electrode being applied with a potential to accelerate electrons emitted from said electron-emitting device, wherein a potential defining region is provided separately at a distance d from said electrode on the surface of said first plate on which said electron-emitting device is provided, and said potential defining region covers a projective area of said electrode onto said potential defining region; and an area extended from a distance of 0.83 d from an outer periphery of the projection area outwardly, in any direction in parallel with said first plate.

2. The electron beam emitting apparatus according to claim 1, wherein said electrode is provided on a second plate opposed to said first plate and said electrode is provided in a range extended by at least a distance 2αd, where α is a number not less than 0.6 and not more than 1, in all directions parallel to said second plate from an edge of an irradiated area which electrons emitted from said electron-emitting device irradiate.

3. The electron beam emitting apparatus according to claim 1, wherein said electron beam emitting apparatus comprises a plurality of said electron-emitting devices.

4. The electron beam emitting apparatus according to claim 3, wherein said plurality of electron-emitting devices are arranged in a matrix pattern.

5. The electron beam emitting apparatus according claim 1, wherein said electron-emitting device is a cold-cathode emission device.

6. An image-forming apparatus comprising the electron beam emitting apparatus as set forth in claim 1, and a fluorescent body, which emits light under irradiation with electrons emitted from the electron-emitting device of the electron beam emitting apparatus.

* * * * *

UNITED STATES PATENT AND TRADEMARK OFFICE

CERTIFICATE OF CORRECTION

PATENT NO. : 6,693,376 B1 
DATED : February 17, 2004
INVENTOR(S) : Nobuhiro Ito et al.

It is certified that error appears in the above-identified patent and that said Letters Patent is hereby corrected as shown below:

Title page,
Item [ 75], Inventors, "Hideaki Mitsutake, Yokohama" should read -- Hideaki Mitsutake, Kanagawa --.

Column 7,
Line 61, "of causes" should read -- of the causes --.

Column 13,
Line 58, "7a need" should read -- 7a needs --.

Column 16,
Line 3, "angle e" should read -- angle θ --.

Column 19,
Line 33, "rest area" should read -- rest of the area --; and
Line 49, "a represents" should read -- ∝ represents --.

Column 20,
Line 57, "claim" should read -- to claim --.

Signed and Sealed this

Twenty-first Day of June, 2005

JON W. DUDAS
*Director of the United States Patent and Trademark Office*